US005215283A

United States Patent [19]

Gould

[11] Patent Number: 5,215,283

[45] Date of Patent: Jun. 1, 1993

[54] SWING-AWAY MAILBOX SUPPORT

[76] Inventor: Richard D. Gould, 1101 E. 28th St., Minneapolis, Minn. 55407

[21] Appl. No.: 890,697

[22] Filed: May 29, 1992

[51] Int. Cl.[5] ..... A47J 47/16

[52] U.S. Cl. ..... 248/145; 232/39; 248/548; 248/900

[58] Field of Search ..... 248/145, 146, 548, 900, 248/158, 225.3; 232/39; 403/235, 236, 237, 191

[56] References Cited

U.S. PATENT DOCUMENTS

| | | | |
|---|---|---|---|
| 1,753,506 | 4/1930 | Florine | 248/145 |
| 2,555,338 | 4/1951 | Dunagan | 248/145 |
| 2,738,941 | 3/1956 | Laurich et al. | 248/145 |
| 3,161,397 | 12/1964 | Nolander | 248/417 |
| 3,272,465 | 9/1966 | Baarsgard | 248/145 |
| 3,407,997 | 10/1968 | Wood, et al. | 232/39 |
| 3,658,284 | 4/1972 | Haasl | 248/145 |
| 3,802,656 | 4/1974 | Virblas | 248/145 |
| 3,867,045 | 2/1975 | Beals | 403/235 X |
| 3,870,262 | 3/1975 | Manning, Jr. | 248/145 |
| 3,881,650 | 5/1975 | Schmidt | 232/39 |
| 3,899,150 | 8/1975 | Racquet | 248/145 |
| 3,999,702 | 12/1976 | Conroy | 232/39 |
| 4,113,213 | 9/1978 | Gay et al. | 232/39 X |
| 4,130,239 | 12/1978 | Belsheim | 232/39 |
| 4,172,579 | 10/1979 | Steinman | 248/145 |
| 4,616,799 | 10/1986 | Rebentisch | 248/900 X |
| 4,792,088 | 12/1988 | Bonnell | 232/17 |
| 4,955,533 | 11/1990 | Merkel | 232/39 |
| 4,955,534 | 11/1990 | Raible | 232/39 |
| 4,995,576 | 2/1991 | Kieswetter | 248/145 |
| 5,020,720 | 6/1991 | Harpe | 232/39 |
| 5,029,783 | 7/1991 | Alvarez | 248/146 |
| 5,042,716 | 8/1991 | Robbins | 232/39 |

*Primary Examiner*—Ramon O. Ramirez
*Attorney, Agent, or Firm*—John W. Bunch

[57] ABSTRACT

An improved mailbox support (10) includes a sectional post (12) interconnected by a resilient coupling (20). The coupling (20) includes a cam (22) and an adjustable internal primary spring (24), and an optional external secondary spring (32)

14 Claims, 1 Drawing Sheet

SWING-AWAY MAILBOX SUPPORT

TECHNICAL FIELD

The present invention relates generally to mountings or supports for mailboxes. More particularly, this invention concerns an improved resilient mailbox support for withstanding incidental impact from vehicles, snowplows and the like.

BACKGROUND

A variety of mailbox supports have been available heretofore, particularly for mailboxes in rural areas which are typically located near roads and are thus susceptible to damage from passing vehicles, snowplows, etc. It is desirable to provide a yieldable and/or movable support for such mailboxes. Several examples of such mailbox supports can be found. Some are simply adapted to rotate or swing out of the way upon impact, while others incorporate spring arrangements to cushion the impact and then return the support to its normal position U.S. Pat. Nos. 2,550,338 to Dunagan, 2,738,941 to Laurich, 3,161,397 to Nolander, 3,802,656 to Virblas, 4,792,088 to Bonnell, and 5,029,783 to Alvarez are representative of the prior art. However, the prior devices have tended to be unnecessarily complicated, difficult to assemble and maintain, or have manifested other drawbacks.

There is still a need for a resilient swing-away mailbox support of improved construction.

SUMMARY OF INVENTION

The present invention comprises an improved swing-away mailbox support which overcomes the foregoing and other difficulties associated with the prior art. The mailbox support herein includes an upright post having upper and lower sections which are interconnected for relative rotation by a cam and a resilient coupling so that the upper section and mailbox mounted thereon are normally biased toward a non-displaced position. The coupling includes an internal spring whose tension is easily adjustable. An optional secondary external spring can be used to provide additional biasing and damping under impact.

BRIEF DESCRIPTION OF DRAWING

A better understanding of the invention can be had by reference to the following Detailed Description in conjunction with the accompanying Drawing, wherein.

DETAILED DESCRIPTION

Figure 1:
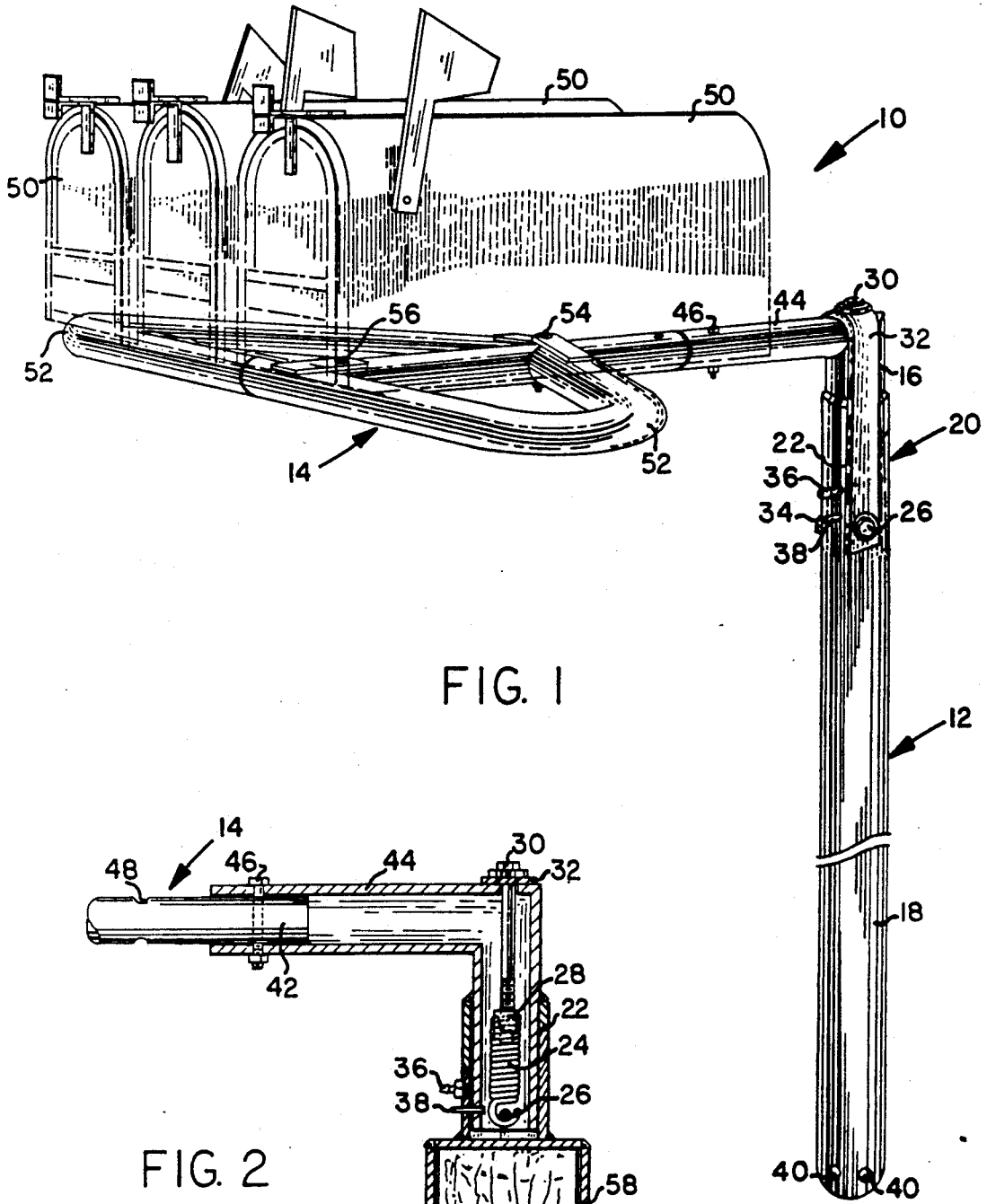
FIG. 1 is a perspective view of the swing-away mailbox support incorporating the invention.

Referring now to the Drawing, wherein like reference numerals designate like or corresponding elements throughout the views, and particularly referring to FIG. 1, there is shown a swing-away mailbox support 10 incorporating the invention. As will be explained more fully hereinafter, the mailbox support 10 incorporates several improvements over the prior art.

Figure 2:
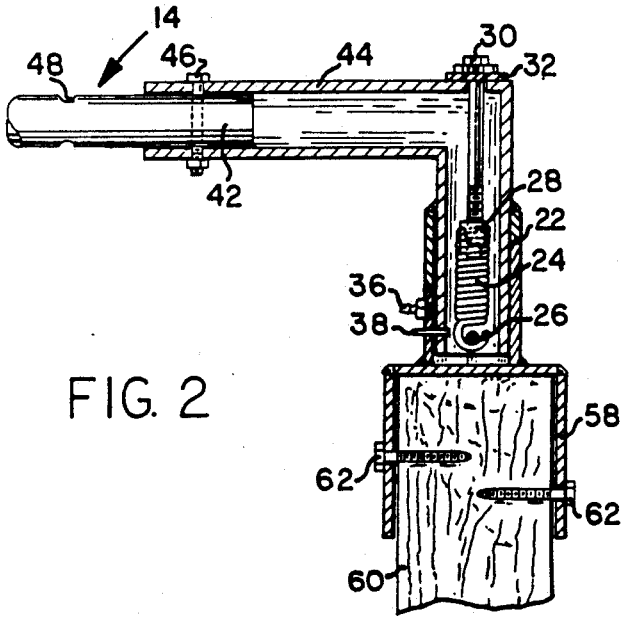
FIG. 2 is a partial side view with portions broken away for clarity, showing an adaptor for mounting on a wooden post.

The mailbox support 10 includes an upright post 12 and a lateral arm 14, both of which are preferably constructed from hollow tubular members or pipe sections cut to fit and secured together The post 12 includes upper and lower sections 16 and 18 interconnected by a coupling 20 which is housed primarily within the post 12 for protection from the weather, etc. In particular, the coupling 20 includes an angled cam surface 22 which is oriented so that the extension 14 and upper post section 16 are normally biased by gravity toward a non-displaced or center position, as well as an adjustable tension spring 24 for additional spring biasing. The angle of inclination of the cam surface 22 is preferably about 30 degrees. The spring 24 is located inside the upper post section 16, as is best seen in FIG. 2. The lower end of the spring 24 is secured to a transverse bolt 26 located below cam surface 22 as shown, while the upper end thereof is secured to an internally threaded follower 28 which in turn is secured to a bolt 30 extending downwardly from the top end of the upper post section 16. The bolt 30 can thus be turned as necessary to adjust the tension in spring 24 and the amount of spring-biasing in the coupling 20.

In accordance with the preferred embodiment, the coupling 20 further includes a resilient strap 32 extending between bolts 26 and 30. In particular, one end of the strap 32 is secured beneath the head of bolt 26, while the middle is secured beneath the head of bolt 30 and the other end thereof is secured beneath a nut 34 on the other end of bolt 26. The strap 32 can be formed of any suitable resilient material, such as rubber tire casing for example. The strap 32 is secured between bolts 26 and 30 in a tight relationship without play so as to act as a secondary spring or damper. This comprises an important feature of the present invention. Washers are preferably provided beneath the heads of bolts 26 and 30 and beneath the nut 34 as shown, in order to help distribute the clamping stresses around the necessary holes in the strap 32.

If desired, a grease fitting 36 can be located near the top end of the lower post section 18 for lubricating the telescoping ends of the post 12.

In order to stabilize the mailbox support 10 from swaying under heavy wind loads, a shear pin 38 can also be provided through registering holes in the overlapping portions of the post 12. A roll pin can be used for the shear pin 38.

If desired, break away holes 40 can be provided near the bottom end of the lower section 18 of post 12. As illustrated, four such break away holes 40 are provided at equally spaced circumferential intervals about post 12, although any suitable number of holes can be utilized. The purpose of the break away holes 40 is to allow the mailbox support post 10 to break off completely for safety purposes in the event of a severe impact.

The extension 14 is secured to the top end of the post 12. In particular, the extension 14 includes a straight tubular member 42 which is received by a laterally extending portion of the upper section 16 of post 12. The extension 14 is secured in place by bolt 46, and additional holes 48 are provided in the member 42 for lateral adjustment, as is best seen in FIG. 2.

One or more mailboxes 50 can be mounted on the extension 14. As illustrated, three mailboxes 50 are mounted thereon, and a laterally extending bumper 52 is provided for supporting the mailboxes. The bumper 52 comprises two generally C-shaped members secured by lugs and bolts 54 at their inner ends to the tubular member 42, as best seen in FIG. 1. The outer ends of the bumpers 52 are telescoped together and secured by another lug and a bolt 56 to the outer end of the tubular member 42. The bumpers 52 extend beyond the sides of the mailboxes 50 in order to help avoid damage to the mailboxes 50 from a passing vehicle, for example, so that any impact can be absorbed by the coupling 20.

Referring particularly to FIG. 2, there is shown an adapter 58 which can be secured to the lower end 18 of post 12 so that the mailbox support 10 can be used with a wooden post 60, secured in place by lag screws 62. The adapter 58 can be of either round or rectangular cross section.

From the foregoing, it will be apparent that the present invention comprises an improved swing away mailbox support having several advantages over the prior art. One significant advantage is that the tension spring of the resilient coupling is enclosed within the upper end of the post, yet is easily adjustable from the outside without any disassembly. Other advantages will be evident to those skilled in the art.

Although particle embodiments of the invention have been illustrated in the accompanying Drawing and described in foregoing Detailed Description, it will be understood that the invention is not limited only to the embodiments disclosed, but is intended to embrace any alternatives, equivalents, modifications, and/or rearrangements of elements falling within the scope of the invention as defined by the following Claims.

What is claimed is:

1. A mailbox support, comprising:

an upright post having upper and lower sections, each section having top and bottom ends;

the bottom end of the upper section of said post being received by the top end of the lower section thereof for relative rotation about a longitudinal axis;

cam means secured between the upper and lower sections of said post for supporting the upper section for rotational movement about the longitudinal axis between displaced and nondisplaced positions;

a tension spring extending within said post, said tension spring having two ends, one end thereof being secured to the lower section of said post;

means accessible from outside said post, said adjustably interconnecting the other end of said tension spring to the upper section of said post in order to normally bias the upper section of said post toward the non-displaced position; and means for supporting at leas tone mailbox on the upper section of said post in raised and laterally spaced relation with the lower section thereof.

2. The mailbox support of claim 1, wherein said post is formed from metal pipe sections.

3. The mailbox support of claim 1, wherein said cam means comprises generally circular collars respectively secured to the upper and lower sections of said post and defining a cam surface therebetween inclined at a predetermined angle.

4. The mailbox support according to claim 3, wherein the angle of inclination is about 30 degrees.

5. A mailbox support, comprising:

an upright post having upper and lower sections, each section having top and bottom ends;

the bottom end of the upper section of said post being received by the top end of the lower section thereof for relative rotation about a longitudinal axis;

cam means secured between the upper and lower sections of said post for supporting the upper section for rotational movement about the longitudinal axis between displaced and nondisplaced positions;

a tension spring extending within said post, said tension spring having two ends, one end thereof being secured to the lower section of said post;

means for adjustably interconnecting the other end of said tension spring to the upper section of said post in order to normally bias the upper section of said post towrd the non-displaced position;

said means for adjustably interconnecting said tension spring to the upper section of said post including a bolt having a head and a shank extending through a hole in the upper section of said post into threaded engagement with said tension spring; and means for supporting at least one mailbox on the upper section of said post in raised and laterally spaced relation with the lower section thereof.

6. The mailbox support of claim 1, further including:

a shear pin extending through registering openings in the overlapping ends of the upper and lower sections of said post.

7. The mailbox support of claim 1, further including:

a grease fitting secured in an access hole in the top end of the lower section of said post.

8. The mailbox support of claim 1, wherein the lower section of said post includes a plurality of circumferentially spaced break away holes near the bottom end thereof.

9. The mailbox support of claim 1, further including:

adapter means secured to the bottom end of the lower section of said post for connection to another post of different size.

10. A mailbox support, comprising:

an upright post having hollow upper and lower sections, each section having top and bottom ends;

the bottom end of the upper section of said post being telescopically received within the top end of the lower section thereof for relative rotation about an upright longitudinal axis;

cam means secured between the upper and lower sections of said post for supporting the upper section for rotational movement between displaced and non-displaced positions;

a transverse bolt for securing one end of said internal tension spring to the lower section of said post;

a longitudinal bolt for adjusting tension in said internal tension spring;

said longitudinal bolt including an external head, a shank extending through a hole in the upper section of said post, and a threaded end engaged with the other end of said internal tension spring;

an external spring extending between said transverse bolt and said longitudinal bolt; and means for securing a mailbox to the upper section of said post.

11. The mailbox support of claim 10, further including:

a shear pin extending through registering openings in the overlapping ends of the upper and lower sections of said post.

12. The mailbox support of claim 10, further including:

a grease fitting secured in an access hole in the top end of the lower section of said post.

13. The mailbox support of claim 10, wherein the lower section of said post includes a plurality of circumferentially spaced break away holes near the bottom end thereof.

14. The mailbox support of claim 10, further including:

adapter means secured to the bottom end of the lower section of said post for connection to another post of different size.

* * * * *